US007900271B2

(12) United States Patent
Sonner

(10) Patent No.: US 7,900,271 B2
(45) Date of Patent: Mar. 8, 2011

(54) BALLISTIC ELBOW AND KNEE GUARDS

(76) Inventor: Matthew Aaron Sonner, Fayetteville, NC (US)

( * ) Notice: Subject to any disclaimer, the term of this patent is extended or adjusted under 35 U.S.C. 154(b) by 253 days.

(21) Appl. No.: 11/358,614

(22) Filed: Feb. 21, 2006

(65) Prior Publication Data

US 2009/0119817 A1 May 14, 2009

Related U.S. Application Data

(60) Provisional application No. 60/655,231, filed on Feb. 22, 2005.

(51) Int. Cl.
*A41D 13/00* (2006.01)

(52) U.S. Cl. ..... 2/24; 2/2.5

(58) Field of Classification Search ..... 2/16, 22, 2/24, 242, 62, 455, 911, 2.5
See application file for complete search history.

(56) References Cited

U.S. PATENT DOCUMENTS 2,266,886 A * 12/1941 McCoy ..... 2/22
3,331,083 A * 7/1967 Holly ..... 2/2.5
3,458,863 A * 8/1969 Lamber et al. ..... 2/2.5
3,577,836 A * 5/1971 Tamura ..... 2/2.5
3,902,196 A * 9/1975 Reinfandt ..... 2/2.5
3,945,047 A 3/1976 Jarrell
3,958,569 A 5/1976 Vosburgh
4,068,312 A 1/1978 Ledesma
4,120,052 A * 10/1978 Butler ..... 2/16
4,195,362 A * 4/1980 Rolando ..... 2/461
4,198,708 A 4/1980 Fugere
4,382,301 A * 5/1983 Hightower, Jr. ..... 2/22
4,599,748 A 7/1986 Garcia
4,685,153 A 8/1987 Sims
4,768,500 A 9/1988 Mason
4,796,303 A 1/1989 Atwater
4,893,355 A 1/1990 Ritter
5,220,691 A * 6/1993 Wiegers ..... 2/24
5,455,969 A 10/1995 Pratson
5,477,559 A * 12/1995 Clement ..... 2/22
5,491,840 A * 2/1996 Yen ..... 2/461
5,500,955 A 3/1996 Gongea
5,537,689 A * 7/1996 Dancyger ..... 2/24
5,594,954 A 1/1997 Huang
5,729,832 A * 3/1998 Grilliot et al. ..... 2/23
5,732,412 A 3/1998 Holden
5,781,935 A * 7/1998 Bassett et al. ..... 2/455
5,915,529 A 6/1999 Popowski
5,952,078 A 9/1999 Park
6,122,768 A * 9/2000 McCrane ..... 2/16
6,253,376 B1 7/2001 Ritter
6,543,055 B2 * 4/2003 Howland et al. ..... 2/2.5
6,584,616 B2 7/2003 Godshaw
6,839,906 B2 * 1/2005 Gold et al. ..... 2/24
6,839,917 B1 * 1/2005 Landwehr ..... 2/455
7,266,850 B1 * 9/2007 Strum et al. ..... 2/2.5
7,571,493 B1 * 8/2009 Purvis et al. ..... 2/2.5

* cited by examiner

*Primary Examiner* — Tejash Patel
(74) *Attorney, Agent, or Firm* — Coats & Bennett, P.L.L.C.

(57) ABSTRACT

Elbow and knee guards for providing protection from fragments, bullets, projectiles, and blunt force trauma injuries. The guards contain ballistic material that is incorporated or inserted into the appropriate carriers. A rigid or semi-rigid ballistic or non-ballistic cap can also be attached to the outer portion of the guards to increase the overall protection provided. Non-ballistic energy absorption material can also be added to increase the overall protection against blunt force trauma injuries.

5 Claims, 5 Drawing Sheets

BALLISTIC ELBOW AND KNEE GUARDS

CROSS-REFERENCE TO RELATED APPLICATIONS

This application claims the benefit of PPA APPL No. 60/655,231, FILING DATE Feb. 22, 2005 by the present inventor.

FEDERALLY SPONSORED RESEARCH

Not applicable

SEQUENCE LISTING OR PROGRAM

Not applicable

BACKGROUND OF THE INVENTION

1. Field of Invention

This invention relates to protective elbow and knee guards for military, police and security personnel particularly adapted to prevent injuries and wounds to elbows and knees.

2. Background of the Invention

I conceived of the ballistic elbow and knee guards while serving in Iraq during 2004. Military personnel wore elbow and knee pads that used non-ballistic material such as Nylon, plastic and foam and suffered wounds and injuries to these areas that could have been prevented if ballistic material was incorporated into the pads.

Unlike previous art in this field, my invention will provide protection and increased survivability against both low and high velocity projectiles, fragments, blunt force trauma, blood loss and lacerations. These threats include projectiles fired from pistols, shotguns, and submachine guns and fragments from the detonation of high explosive weapons. These weapons include, but are not limited to, road side bombs, hand and rocket propelled grenades, mortar and artillery rounds, land mines and booby traps. This invention will also provide protection to the knees and elbows from sharp cutting objects such as glass and sheet metal.

The level of protection is up to the agency and/or wearer and is based on the US National Institute of Justice guidelines and Certification tests for different ballistic material. They range from Threat levels I through IIIA. Level I material will protect the wearer from bullets and fragments with a velocity and weight comparable to a .38 cal pistol round weighing 158 grains and moving at 850 feet per second. Level IIIA material will protect the wearer from bullets and fragments with a velocity and weight comparable to a .44 Magnum pistol round weighing 240 grains and moving at 1,400 feet per second.

U.S. Pat. No. 6,988,281 to Jerome and Rudiy discloses a strapless kneepad kit for installing releasable fasteners to the kneepad and to corresponding locations on the seams of work pants or jeans in the kneecap area.

U.S. Pat. No. 6,807,682 to Shircliff discloses a knee pad assembly for protecting the knee of a worker working on hard floors and consists of and outer knee pad structure, a knee cap support spring, and a resilient foam inner knee and shin pad structure.

U.S. Pat. No. 6,279,160 to Chen discloses a joint protector that is designed to protect the elbows and knees from an oblique, non-direct, or proximal impact.

U.S. Pat. No. 6,253,376 to Ritter discloses a knee pad for cushioning the human knee that includes a fluid filled chamber and removable knee cups that that are comprised of different material to suit a particular activity.

U.S. Patent Application 20040019949 to Crockett discloses a method and apparatus for attaching knee or elbow pads to clothing with fasteners.

The patents and patent application mentioned above are designed to protect joints from non-ballistic injuries and do not provide any significant protection from fragments, bullets or projectiles.

OBJECTS AND ADVANTAGES

Accordingly, besides the objects and advantages of the ballistic elbow and knee guards described in my above patent several objects and advantages of the present invention are:

(a) to decrease wounding and death of personnel from impacts of both low and high velocity projectiles to the elbows and knees.

(b) to decrease wounding and death of personnel from impacts of both low and high velocity fragments to the elbows and knees.

(c) to decrease wounding and death of personnel from impacts of both low and high velocity bullets to the elbows and knees.

(d) to decrease injuries and death of personnel from lacerations to the elbows and knees such as those sustained in vehicular and aircraft accidents.

(e) to decrease injuries and death of personnel from blood loss from wounds and injuries sustained to the elbows and knees.

(f) to make current non-ballistic elbow and knee pads worn by military, security and law enforcement personnel obsolete as they offer no significant ballistic protection.

(g) to save the US taxpayer money by decreasing the number of personnel who will need to be treated for injuries and wounds sustained to the elbows and knees.

Still further objects and advantages will become apparent from a consideration of the ensuing description and drawings.

SUMMARY

The invention, elbow and knee pads for military, police, and security personnel that incorporates ballistic material.

Accordingly, several objects and advantages of the invention are to provide improved elbow and knee pads, to provide increased protection from fragments, bullets, projectiles, lacerations and blunt force trauma injuries.

BRIEF DESCRIPTION OF THE DRAWINGS

Some of the objects of the invention have been set forth above. Other objects and advantages of the invention will appear as the invention proceeds when taken in conjunction with the following drawings, in which.

DRAWINGS

Reference Numerals

Figure 1:
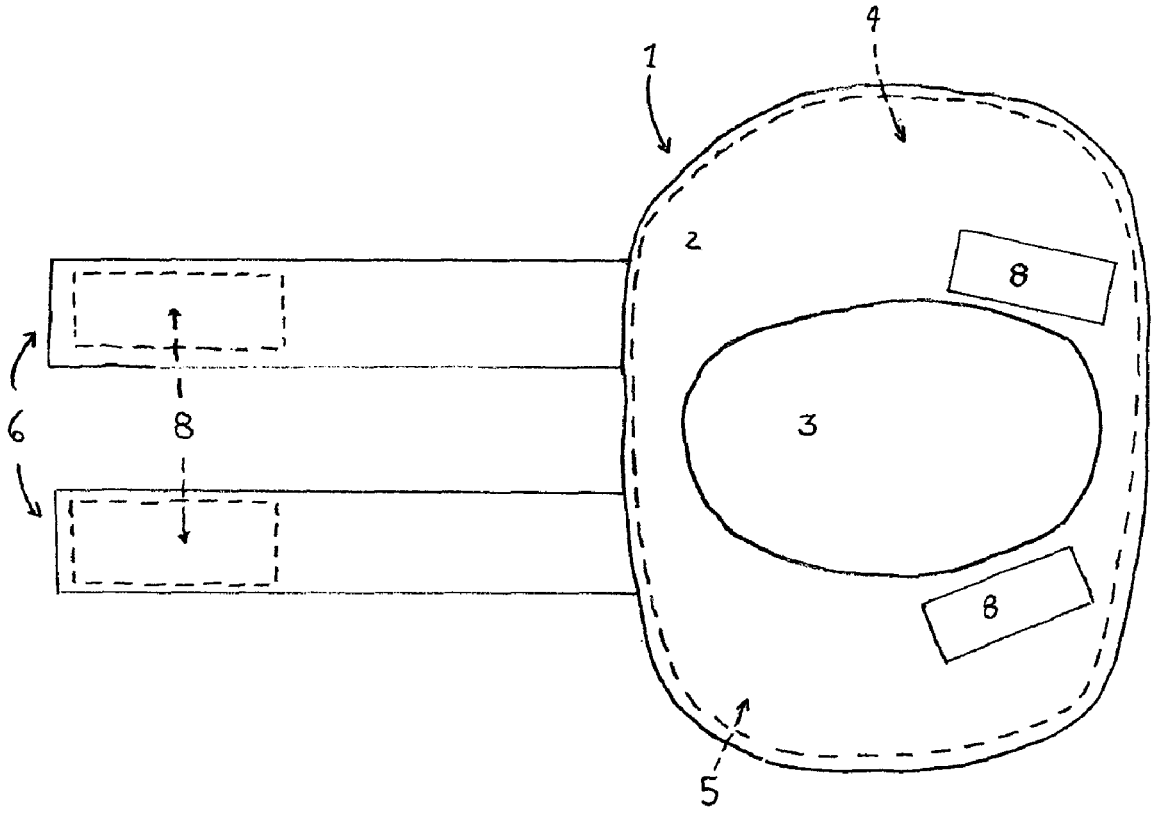
FIG. 1 is a front view of the ballistic elbow guard according to the principles of the present invention, illustrating one embodiment of the elbow guard in an unworn condition.

1 elbow guard
2 ballistic panel and non-ballistic cushioning pad carrier shell
3 ballistic or non-ballistic cap
4 ballistic panel
5 non-ballistic cushioning pad
6 adjustable tightening straps
7 knee guard
8 VELCRO fasteners
9 loop fasteners
10 hook fasteners
11 adjustable tightening straps

DETAILED DESCRIPTION OF THE INVENTION

Referring now to the drawings and, in particular to FIG. 1, there is shown a novel ballistic resistant and energy absorption elbow guard of the present invention identified by the numeral 1. In general, the ballistic elbow guard is designed to resemble elbow protectors that are worn by military and law enforcement personnel. However, it will be understood that any elbow protector, pad or guard may be adopted to include the ballistic protective properties of the present invention.

Figure 2:
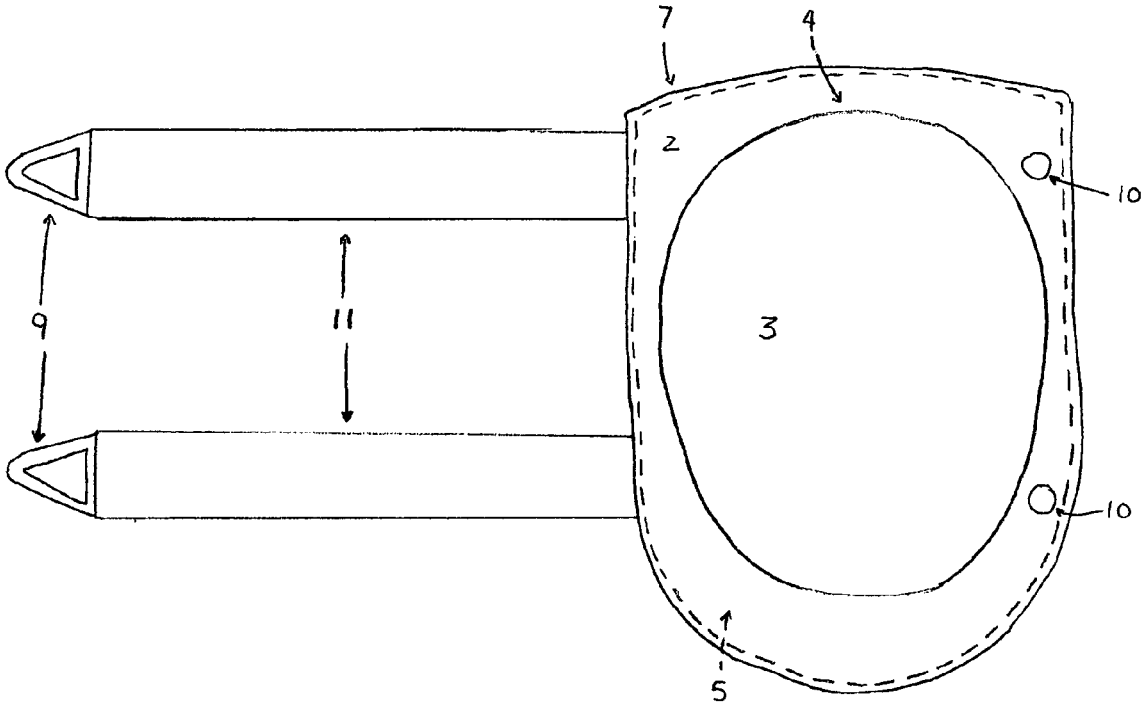
FIG. 2 is a front view of the ballistic knee guard according to the principles of the present invention, illustrating one embodiment of the knee guard in an unworn condition.
Figure 3:
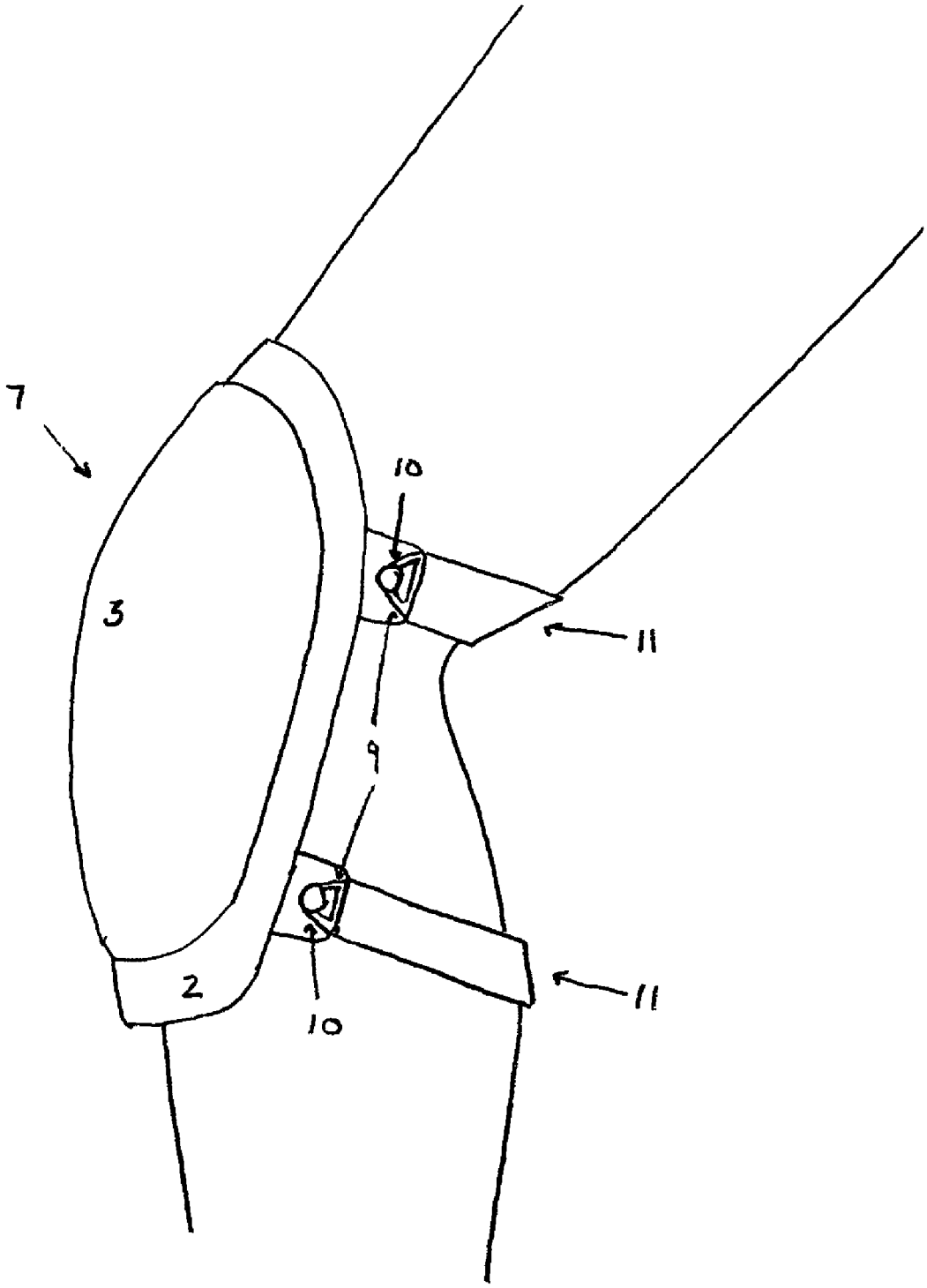
FIG. 3 is a perspective view of the ballistic knee guard according to the principles of the present invention in a worn condition.

Referring now to the drawings and, in particular to FIG. 2, there is shown a novel ballistic resistant and energy absorption knee guard of the present invention identified by the numeral 7. In general, the ballistic knee guard is designed to resemble knee protectors that are worn by military and law enforcement personnel. However, it will be understood that any knee protector, pad or guard may be adopted to include the ballistic protective properties of the present invention.

Figure 4:
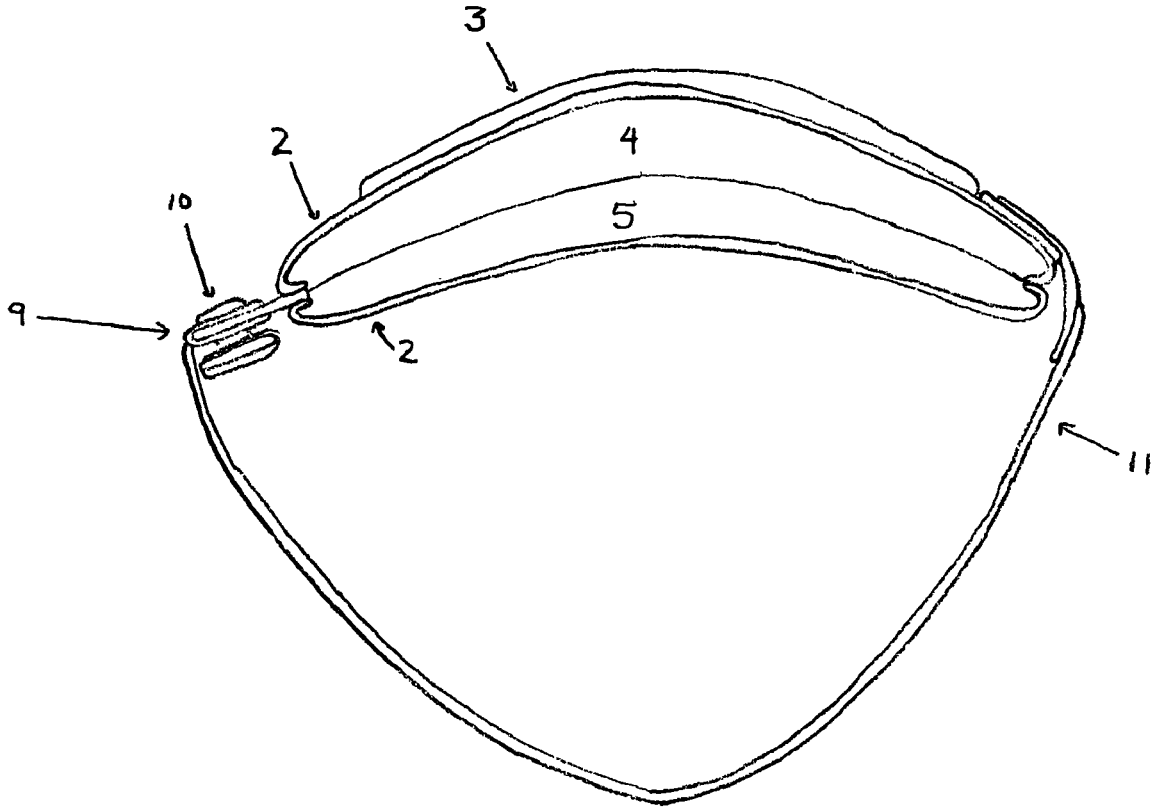
FIG. 4 is cross sectional view of both the ballistic elbow and knee guard in an unworn condition.
Figure 5:
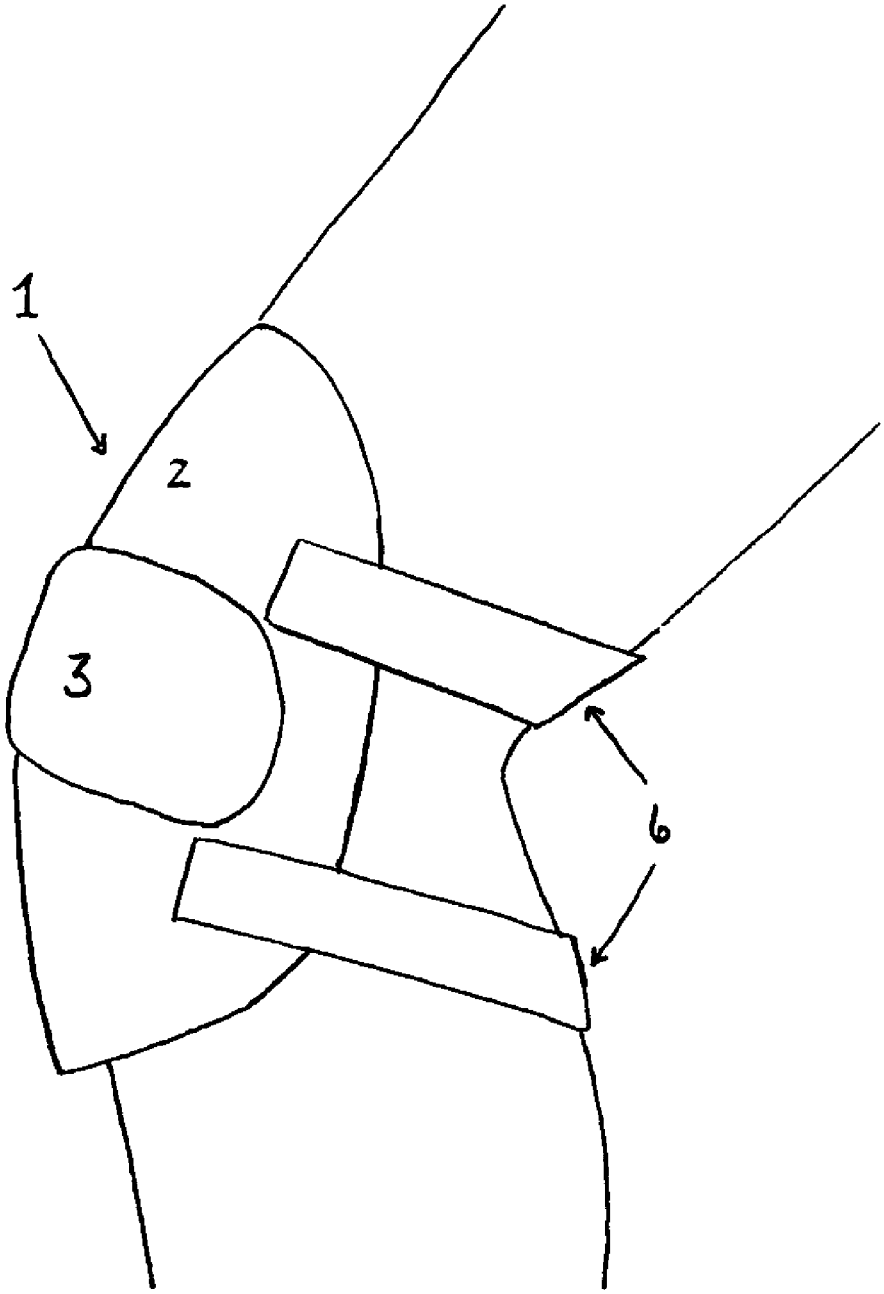
FIG. 5 is a perspective view of the ballistic elbow guard according to the principles of the present invention in a worn condition.

Referring to FIGS. 1, 2 and 4 panel carrier shells 2, receives ballistic panel inserts 4. To increase the cushioning properties of the elbow 1 and knee guards 7, non-ballistic cushioning pads 5 can be incorporated behind the ballistic panel inserts. The non-ballistic cushioning pads 5 can be comprised of any energy absorption material such as foam or a chamber or chambers filled with fluids, gases, liquids or gels.

Referring to FIGS. 1, 2, 3, 4 and 5 caps 3 made of rigid or semi rigid ballistic or non-ballistic material is attached to the carrier shells 2.

Referring to FIG. 1 adjustable fastening straps 6 are attached to the sides of the elbow panel carrier shells 2 and are preferably comprised of elastic material. The adjustable fastening straps 6 can be secured to the opposite side of the carrier shell 2 using VELCRO type fasteners 8. Alternately, the adjustable fastening straps 6 can be attached by the wearer to the opposite side of the elbow guards using hook and loop fasteners.

Referring to FIG. 2 adjustable fastening straps 11 are attached to the sides of the knee panel carrier shells 2 and are preferably comprised of elastic material. The adjustable fastening straps 11 can be secured to the opposite side of the carrier shell 2 using hook 10 and loop 9 fasteners. Alternately, the adjustable fastening straps 11 can be attached by the wearer to the opposite side of the knee guards by using VELCRO type fasteners.

The subject invention is not limited to the style of the ballistic knee and elbow pads shown in the drawings and may be subject to many modifications and changes without departing from the spirit or essential characteristics thereof. The present specification should therefore be considered in all respects as illustrative and not restrictive of the scope of the present invention as defined by the appended claims.

Operation

In operation one wears the ballistic elbow and knee guards by strapping or slipping them over the appropriate area of the body or attaching them to the clothing so as to provide protection from both ballistic and non-ballistic threats. If the carrier shell is damaged beyond repair, the ballistic and non-ballistic panels can be removed so as to install into serviceable carriers.

CONCLUSIONS, RAMIFICATIONS, AND SCOPE

Thus the reader will see that the ballistic elbow and knee guards offer military and law enforcement personnel significant protection from being struck by bullets, fragments and projectiles that would otherwise cause serious wounds and death. They are lightweight and comfortable and will make current issue non-ballistic knee and elbow pads obsolete.

- they will increase the combat effectiveness of our military forces as they fight the Global War on Terror by providing ballistic protection to their elbows and knees.
- they will decrease the costs associated with the long term care of those who are permanently maimed by reducing the number of military and law enforcement personnel who are wounded or injured.
- they will provide law enforcement personnel who are in a high risk environment protection from bullet strikes to their elbows and knees.

I claim:

1. A ballistic elbow or knee guard for providing ballistic protection for the elbow or knee of a person, the guard comprising:

(a) a carrier;

(b) a ballistic panel supported by the carrier and disposed in the ballistic elbow or knee guard so as to overlie the elbow or knee of the person;

(c) the ballistic panel being constructed to provide at least threat level I protection wherein threat level 1 protection will protect a wearer from bullets and fragments with a velocity and weight comparable to a .38 caliber pistol round weighing 158 grains and moving at 850 feet per second; and (d) an attaching structure attaching and supporting the ballistic elbow or knee guard adjacent the elbow or knee.

2. The ballistic elbow or knee guard of claim 1 including a cushioning pad supported by the carrier adjacent the ballistic panel.

3. The ballistic elbow or knee guard of claim 1 wherein the ballistic panel is detachably secured to the carrier.

4. The ballistic elbow or knee guard of claim 1 wherein the attaching structure includes a plurality of straps.

5. The ballistic elbow or knee guard of claim 4 wherein one or more of the plurality of straps extends from the carrier.

* * * * *